US005733173A

United States Patent [19]

Whittle et al.

[11] Patent Number: 5,733,173

[45] Date of Patent: Mar. 31, 1998

[54] PHARMACEUTICAL GRINDING APPARATUS AND METHOD FOR USING SAME

[76] Inventors: Robert R. Whittle, 5006 Pine Needles Dr., Wilmington, N.C. 28403; Gerald Sakowski, 700 Darwin Dr., Wilmington, N.C. 28405

[21] Appl. No.: 608,751

[22] Filed: Feb. 29, 1996

[51] Int. Cl.[6] ..... B02C 1/08

[52] U.S. Cl. ..... 451/33; 451/328; 241/30; 241/228; 241/DIG. 27

[58] Field of Search ..... 451/32, 33, 34, 451/326, 327, 328, 329, 330; 241/30, 228, DIG. 27

[56] References Cited

U.S. PATENT DOCUMENTS

| | | | |
|---|---|---|---|
| 373,342 | 11/1887 | Cornelius | 241/228 |
| 1,428,687 | 9/1922 | Ferencz | 241/228 |
| 1,475,693 | 11/1923 | Ferencz | 241/228 |
| 2,883,118 | 4/1959 | Taylor | 451/328 |

FOREIGN PATENT DOCUMENTS

| | | | |
|---|---|---|---|
| 1203100 | 10/1965 | Germany | 241/DIG. 21 |

*Primary Examiner*—Eileen P. Morgan

*Attorney, Agent, or Firm*—Myers Bigel Sibley & Sajovec, LLP

[57] ABSTRACT

An apparatus for grinding a solid material into a granulated powder formed of particles of generally uniform size includes: a mounting frame; a grinding vessel mounted on the mounting frame which has a grinding cavity defined by a substantially planar floor, a substantially planar ceiling parallel and opposed to the vessel floor, and a substantially circular internal wall; a circular grinding disk positioned within the grinding cavity; and a drive motor or other revolving means for revolving the grinding vessel along an essentially circular path. The revolving motion of the grinding cavity should cause the grinding disk to contact and roll a solid material against the cavity internal wall and thereby grind a solid material contained therein into granules of substantially uniform size.

12 Claims, 6 Drawing Sheets

PHARMACEUTICAL GRINDING APPARATUS AND METHOD FOR USING SAME

FIELD OF THE INVENTION

The present invention relates generally to the grinding of solid materials, and relates more specifically to apparatus suitable for grinding solid pharmaceutical materials.

BACKGROUND OF THE INVENTION

Pharmaceutical compositions are often produced and provided as solid materials, such as tablets, capsules, lozenges, powders, and the like. In this form, they are easily handled, stored, and administered orally, and they also generally have a lengthy shelf life. Solid pharmaceutical compositions typically include an active pharmaceutical agent and a pharmaceutical diluent or carrier, such as starch, sucrose, lactose, kaolin, dicalcium phosphate, gelatin, acacia, corn syrup, corn starch, or talc, which assists in delivery of the active agent.

Once a solid pharmaceutical composition has been formulated and produced, it is typically analyzed quite extensively for formulation accuracy, homogeneity, and other properties important to the efficacy of the composition. Procedures such as X-ray diffraction, X-ray fluorescence, or high precision liquid chromatography may be performed on a composition. In such analytical work, a solid composition is generally most easily analyzed as a granulated powder. However, providing a suitable granulated powder for analysis can present significant obstacles. For example, for analytical purposes the powdered material should contain the same components in the same chemical form as a tablet contains. This may appear trivial, but many, if not most, pharmaceutical compositions include active agents that are organic compounds. As such, these active agents can be degraded or may undergo a solid state polymorphic phase transition if exposed to excessive heat or energy. Either of these events would, of course, alter the results of an analysis of the powder. The same can be true of additives to the pharmaceutical composition, such as sugars, which can pyrolyze at relatively low levels of heat or energy. In addition, it is desirable that the powder comprise granules of generally uniform size, as the use of particles of non-uniform size can significantly influence the results of a quantitative analysis, particularly if X-ray diffraction and X-ray fluorescence analyses are performed. Thus, it is important that (a) the particles of a given sample be generally uniform in size, and (b) particles from different samples of the same composition also be of generally uniform size so that the results from these different samples can be considered as reliable.

Perhaps the best-known and most widely-used device for grinding a solid material into a powder is the "mortar and pestel," which has been employed by chemists for years to manually grind a solid between two contacting hard surfaces. Obviously, because mortar and pestel grinding is a manual operation, obtaining a uniform particle size, either within a sample or for different samples prepared by different people, is virtually impossible. Additionally, this method is tedious and labor-intensive.

Automated devices for grinding pharmaceuticals exist. For example, the so-called "ball mills" include a cylindrical container within which the sample and a solid crushing ball are placed. The container is placed in a shaking apparatus, which shakes the container along its longitudinal axis and thereby causes the ball to move therein from end to end in a "FIG. 8"-like motion. This action of the ball crushes the sample and thus reduces its particle size. However, these devices are typically extremely limited in sample size (<1 g) capability and typically generate a significant amount of heat, and they often fail to produce a uniform particle size.

Another device used to grind pharmaceuticals is a pulverizer, which typically includes a pulverizing blade that rotates within a chamber. The rotary blade contacts and crushes a compressed pharmaceutical product such as a tablet to its original uncompressed form. The particle size of the sample is generally not reduced, these devices generally generate a great deal of heat with prolonged grinding, and they also often fail to produce particles that are either uniform in size or small enough for reliable and reproducible analysis.

SUMMARY OF THE INVENTION

In view of the foregoing, it is an object of the present invention to provide an apparatus and an associated method for producing a powder formed of particles of generally uniform size from a solid pharmaceutical material.

It is also an object of the present invention to provide an apparatus and an associated method for producing a powder formed of particles of generally uniform size from a solid pharmaceutical material without generating significant heat or energy within the material to avoid degradation or a solid state polymorphic phase transition within the active pharmaceutical agent or another component of the solid material.

These and other objects are satisfied by the present invention, which is directed to an apparatus and a method for grinding a solid material into a granulated powder formed of particles of generally uniform size. The grinding apparatus comprises: a mounting frame; a grinding vessel mounted on the mounting frame which has a grinding cavity defined by a substantially planar floor, a substantially planar ceiling parallel and opposed to the vessel floor, and a substantially circular internal wall; a circular grinding disk positioned within the grinding cavity; and a drive motor or other revolving means for revolving the grinding vessel along an essentially circular path. The revolving motion of the grinding cavity should cause the grinding disk to contact and roll a solid material against the cavity internal wall and thereby grind the solid material contained therein into granules of substantially uniform size.

In one embodiment of the present invention, the grinding vessel is revolved at a rate of between 300 and 500 rpm. This rate is particularly effective in limiting the amount of heat generated during grinding, thereby reducing the risk that a heat-sensitive pharmaceutical agent contained in the solid material may degrade or undergo a solid state polymorphic transition.

In another embodiment of the present invention, two or more grinding vessels are mounted simultaneously on the mounting frame and are revolved simultaneously. If these grinding vessels are loaded with the same solid material in similar amount, the grinding that occurs should produce very similar powdered samples that provide reproducible analytical results.

In still another embodiment, the present invention provides a method for mixing at least two powdered compositions. This method commences with the loading of a single grinding vessel as described hereinabove with at least two different powdered compositions. A grinding disk as described above is also loaded into the grinding vessel. The vessel is then revolved along a substantially circular path at a rate and for a time sufficient to mix the first and second powdered compositions into a substantially homogeneous powdered mixture.

DETAILED DESCRIPTION OF THE INVENTION

The present invention will now be described more fully hereinafter with reference to the above-described Figures. This invention may, however, be embodied in many different forms and should not be construed as limited to the embodiments set forth herein; rather, these embodiments are provided so that this disclosure will be thorough and complete and will fully convey the scope of the invention of those skilled in this art.

Figure 1:
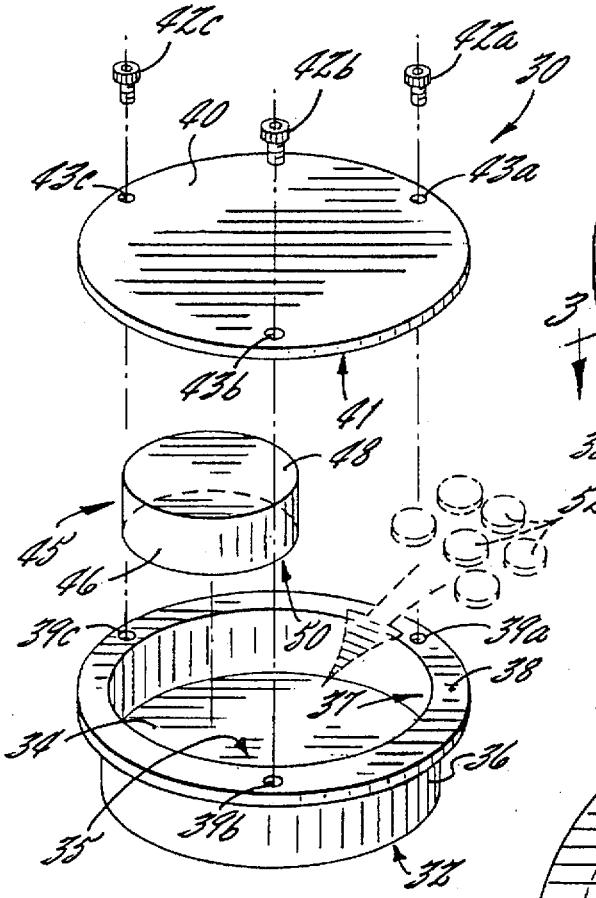
FIG. 1 is an exploded perspective view of a grinding vessel to be used with a grinding apparatus of the present invention.
Figure 2:
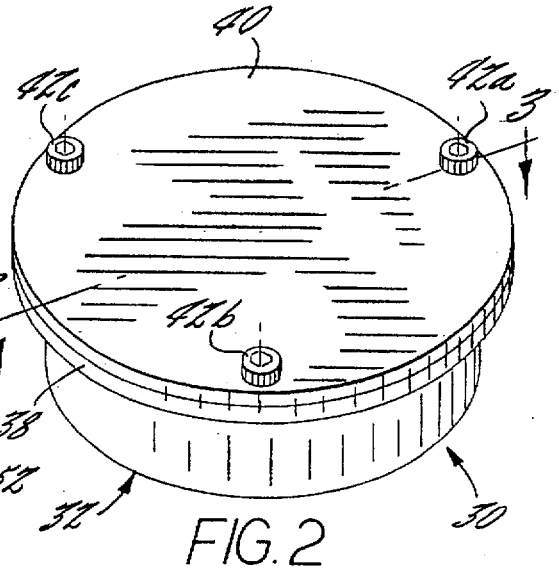
FIG. 2 is an assembled perspective view of the grinding vessel of FIG. 1.

Referring now to the Figures, a grinding vessel, illustrated broadly at 30, is shown in FIG. 1. The grinding vessel 30 includes a container 32 and a lid 40, which can be assembled to house a grinding disk 45 and a solid material, such as tablets 52, to be ground into a powder.

The container 32 is generally a short, open-ended cylinder that includes a circular planar floor 34 having an upper surface 35 (FIGS. 1 through 4). A circular upright wall 36 rises from the periphery of the floor 34 and includes a substantially circular internal surface 37. A circular lip 38 extends radially outwardly from the upper portion of the wall 36. Three threaded apertures 39*a*, 39*b*, 39*c* are spaced circumferentially substantially equally from one another on the lip 38.

The lid 40 comprises a planar circular disk having a lower surface 41 (FIGS. 1 through 4). Three apertures 43*a*, 43*b*, 43*c* are spaced about the edge portion of the lid 40 to align with the apertures 39*a*, 39*b*, 39*c* of the container lip 38. Three screws 42*a*, 42*b*, 42*c* are inserted through apertures 43*a*, 43*b*, 43*c* of the lip 40 and are threadedly received in apertures 39*a*, 39*b*, 39*c* to attach the lid 40 to the container lip 38 such that the lid lower surface 41 and the container floor upper surface 35 are substantially parallel.

Figure 4:
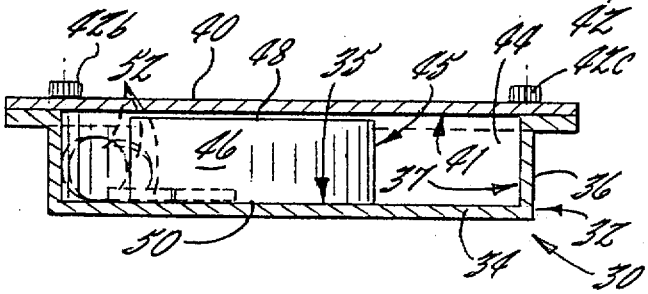
FIG. 4 is a section view of the grinding vessel taken along lines 4—4 of FIG. 3.

Once the lid 40 is attached to the container 32, the floor upper surface 35, the wall internal surface 37 and the lid lower surface 41 define a grinding cavity 44 (FIG. 4). Typically, this grinding cavity is between about 4 and 6 inches in diameter, with a diameter of between about 4.5 and 5.5 inches being preferred, and is between about 0.75 and 1.25 inches in height.

Those skilled in this art will appreciate that, although the illustrated configuration of the grinding vessel 30 is preferred, other configurations thereof may also be suitable. For example, the lip 38 may be omitted, or the exterior surface of the wall 36 or the floor 34 may be varied in shape. The grinding vessel 30 should be configured so that the grinding cavity walls are substantially circular and the floor upper surface and lid lower surface are substantially flat and parallel.

Figure 3:
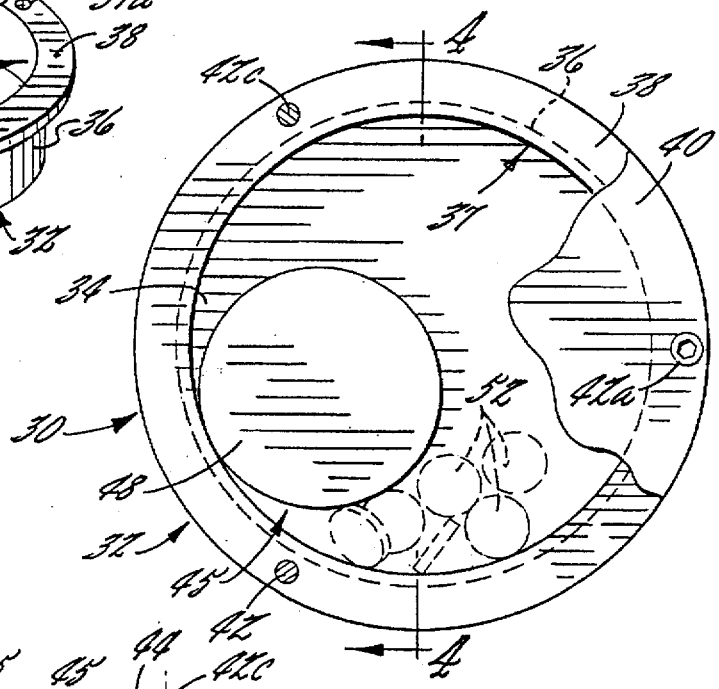
FIG. 3 is a top section view of the grinding vessel taken along lines 3—3 of FIG. 2.

The grinding disk 45 is configured to fit within the grinding cavity 44 (FIGS. 1, 3 and 4). The disk 45 includes an upright substantially cylindrical surface 46 and top and bottom surfaces 48, 50. Preferably, the disk 45 is sized such that its diameter is at least half of the diameter of the grinding cavity 44, and such that the distance between its top surface 48 and its bottom surface 50 is slightly less than the distance between the floor upper surface 35 and the lid lower surface 41. An exemplary disk 45 used with a grinding cavity having a diameter of 4.9375 inches and a height of 1 inch has a diameter of 3 inches and a height of 0.9375 inch.

The grinding vessel 30 and grinding disk 45 can be formed of virtually any material with sufficient hardness to grind a solid material into a granulated powder. Preferred materials for the grinding vessel 30 and grinding disk 45 include various stainless steels and tungsten carbide steel.

Still referring to FIGS. 1, 3 and 4, exemplary tablets 52 are illustrated within the grinding cavity 44. These tablets 52 represent a pharmaceutical composition to be ground into a granulated powder. Those skilled in this art will recognize that, although a tablet form of the pharmaceutical is illustrated herein, other solid composition forms, such as capsules, gel caps, lozenges, and large granular powders, can also be used with the present invention. Also, the skilled artisan will recognize that, as used herein, a "pharmaceutical composition" is a composition containing at least one active pharmaceutical agent; i.e., one which has a therapeutic effect when administered to a subject in need of a therapeutic treatment. Pharmaceutical compositions particularly suitable for use with the present invention include at least one active agent which is an organic compound, especially those with heat-sensitive organic compounds. As used herein, "heat-sensitive" compound is one that is susceptible to degrading or undergoing a solid state polymorphic phase transition at elevated temperatures or energy levels.

Referring now to FIGS. 5 through 8, an alternative grinding vessel 60 is illustrated. The grinding vessel 60 includes a container 62 and a lid 70. The container 62 is generally an open cylinder having a floor 64 with an upper surface 65 and an upright wall 66 with an internal surface 67. On the upper face of the wall 66 are two threaded apertures 69*a*, 69*b*. The lid 70 is a planar circular disk having a lower surface 71 that mates with the upper portion of the container wall 66. The lid 70 includes two apertures 73*a*, 73*b* that align with the apertures 69*a*, 69*b* of the container wall 66. Two screws 72*a*, 72*b* are inserted through the apertures 73*a*, 73*b* and are threadedly received within the apertures 69*a*, 69*b* of the container wall 66.

Figure 5:
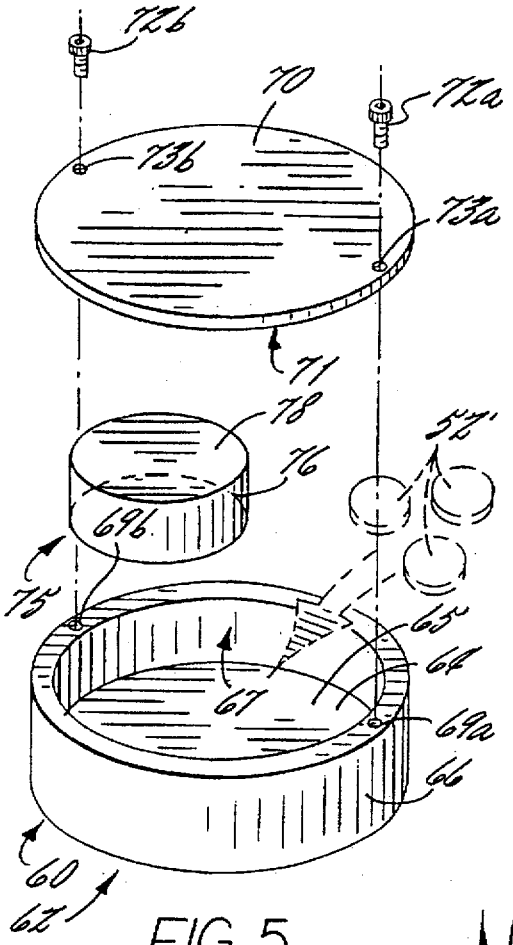
FIG. 5 is a perspective view of an alternative embodiment of a grinding vessel to be used with a grinding apparatus of the present invention.
Figure 6:
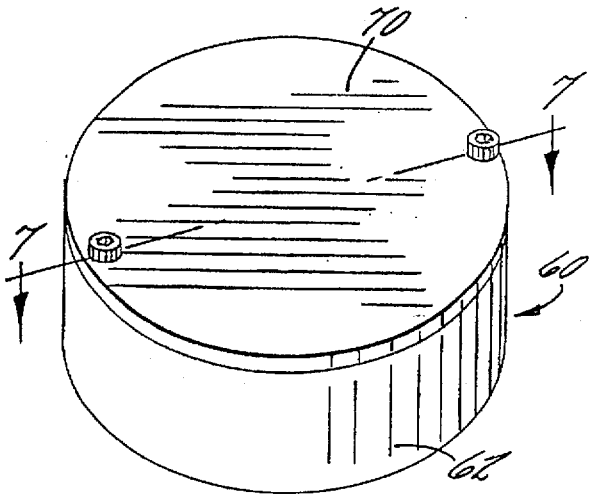
FIG. 6 is an assembled perspective view of the grinding vessel of FIG. 5.
Figure 7:
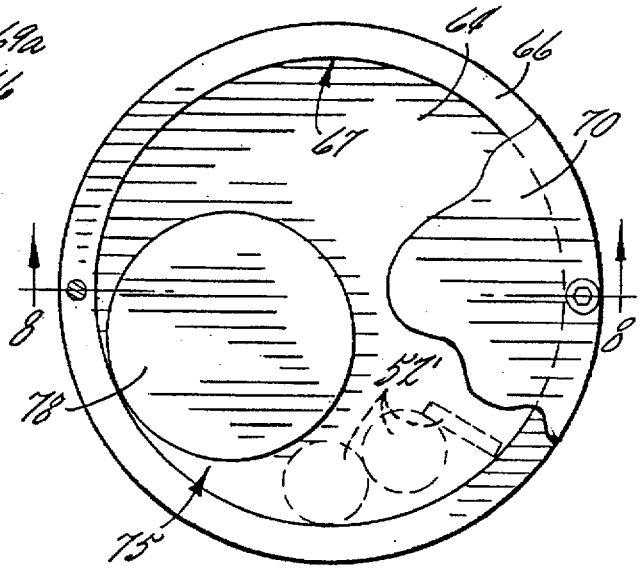
FIG. 7 is a top section view of the grinding vessel taken along lines 7—7 of FIG. 6.
Figure 8:
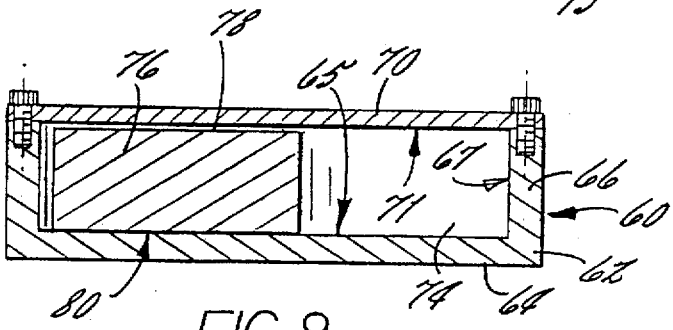
FIG. 8 is a section view of the grinding vessel taken along lines 8—8 of FIG. 7.

When the lid 70 is attached to the container 66, a grinding cavity 74 is formed; this grinding cavity 74 is defined by the container floor upper surface 65, the container wall internal surface 67, and the lid lower surface 71 (FIGS. 5, 7 and 8).

As with the embodiment of FIGS. 1 through 4, a disk 75 is included within the grinding cavity 74 (FIGS. 5, 7 and 8). The disk 75 includes a cylindrical surface 76, a top surface 78, and a bottom surface 80. As was the case for the earlier described embodiment, preferably the disk 45 has a diameter that is at least half of the diameter of the container wall internal surface 67 and a height between its top surface 78 and its bottom surface 80 that is just slightly less than the distance between the container floor upper surface 65 and the lid lower surface 71.

Those skilled in this art will recognize that the general discussion regarding the configuration of the grinding vessel 30 is equally applicable to the grinding vessel 60. In a preferred embodiment, the diameter of the vessel wall internal surface 67 for this embodiment is about 2.5 inches and the height is about 2.5 inches and the height is about 0.5 inches, and the diameter of the disk is about 1.5 inches at a height of 15/32 of an inch.

FIGS. 5, 7 and 8 also include exemplary tablets 52' which are to be ground into a granulated powder. Those skilled in this art will recognize that the discussion hereinabove regarding the tablets 52 is equally applicable to the tablets 52.

Figure 9:
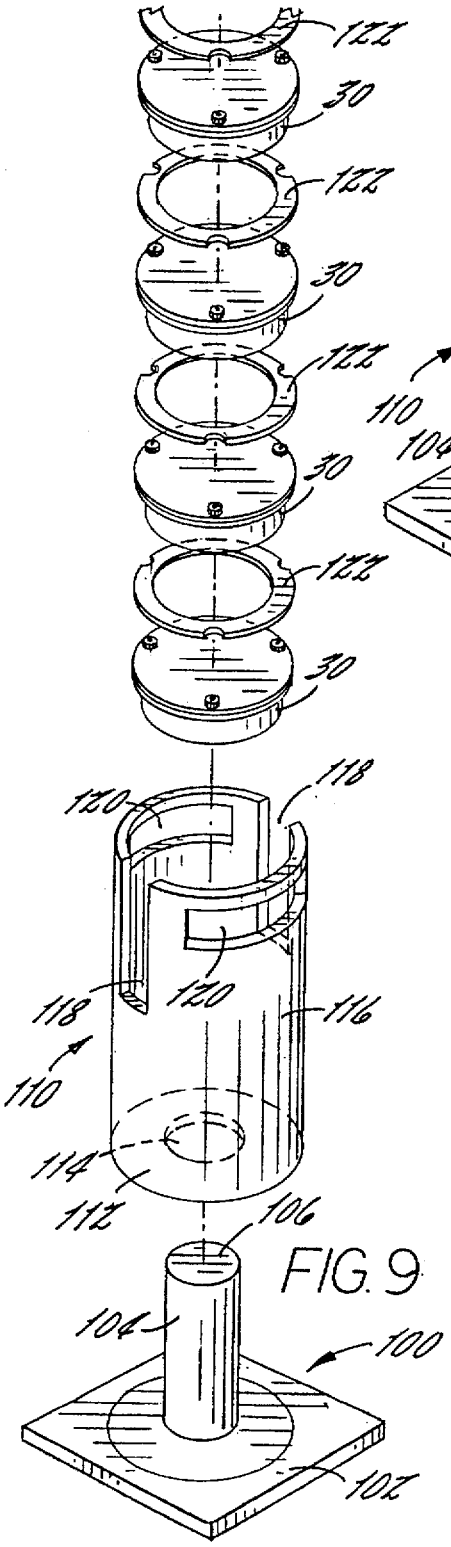
FIG. 9 is an exploded perspective view of a loading apparatus, a mounting receptacle, and four grinding vessels of the present invention.
Figure 10:
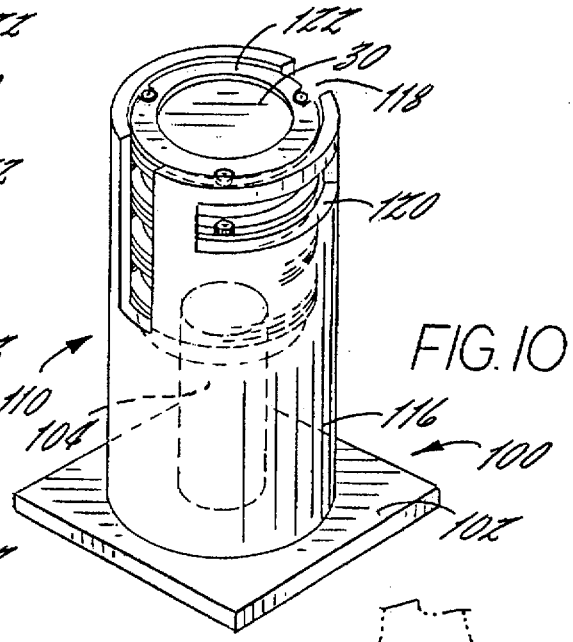
FIG. 10 is an assembled perspective view of the loading apparatus and mounting container of FIG. 9 having the four grinding vessels loaded therein.
Figure 11:
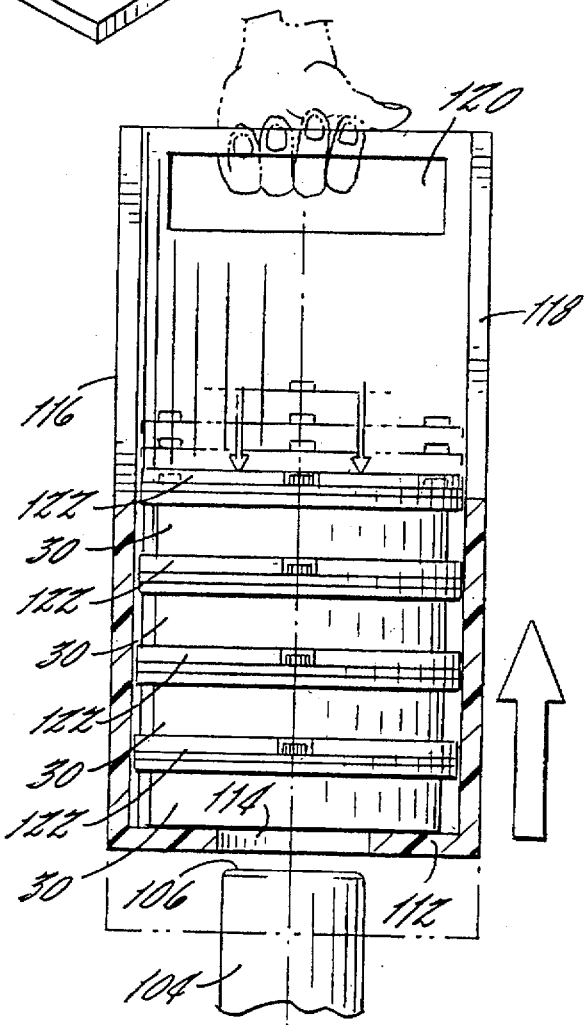
FIG. 11 is a section view of the receptacle of FIG. 9 after it has been lifted from the loading apparatus.

Turning now to FIGS. 9 through 11, a loading apparatus 100 and a mounting receptacle 110 are illustrated that are particularly suited for use with the grinding vessel 30 shown in FIGS. 1 through 4. The loading apparatus 100 includes a generally flat, horizontally-disposed platform 102 from which a cylindrical post 104 rises. The generally cylindrical mounting receptacle 110 has an open upper end and a floor 112 at its lower end. The floor 112 includes a large aperture 114 sized to receive the loading apparatus post 104. The mounting receptacle 110 includes upright sidewalls 116 which have slots 118 that extend downwardly from the upper ends of the sidewall 116. Two circumferentially-extending handle apertures 120 are positioned on opposite upper portions of the sidewall 116.

The illustrated mounting receptacle 110 is configured to receive four grinding vessels 30. Those skilled in this art will recognize that the mounting receptacle 110 can be configured to receive more or fewer grinding vessels as desired.

Loading of the grinding vessels 30 into the mounting receptacle 110 begins with the placement of the mounting receptacle 110 on the loading apparatus 100 such that the floor 112 rests against the loading apparatus platform 102 and the post 104 extends upwardly through the aperture 114. A grinding vessel 30 can then be grasped on opposite sides of its lip 38 and lowered so that its floor 34 rests upon the upper face 106 of the post 104. This process is most easily carried out if the operator's hands are positioned within the loading slots 118 while the grinding vessel 30 is being lowered. A flat spacer 122, preferably formed of nylon or another resilient material, is then placed atop the grinding vessel lid 40. At this point, another grinding vessel 30 is lowered onto the spacer 122; this process of alternately loading grinding vessels 30 and spacers 122 is continued until four grinding vessels 30 and four spacers 122 have been loaded. The mounting receptacle 110 is then grasped using the handle apertures 120 and lifted until its floor 112 clears the loading apparatus post 104. As this lifting occurs, the grinding vessels 30 descend within the mounting vessel 110 until the lowermost grinding vessel 30 rests upon the mounting receptacle floor 112.

Figure 12:
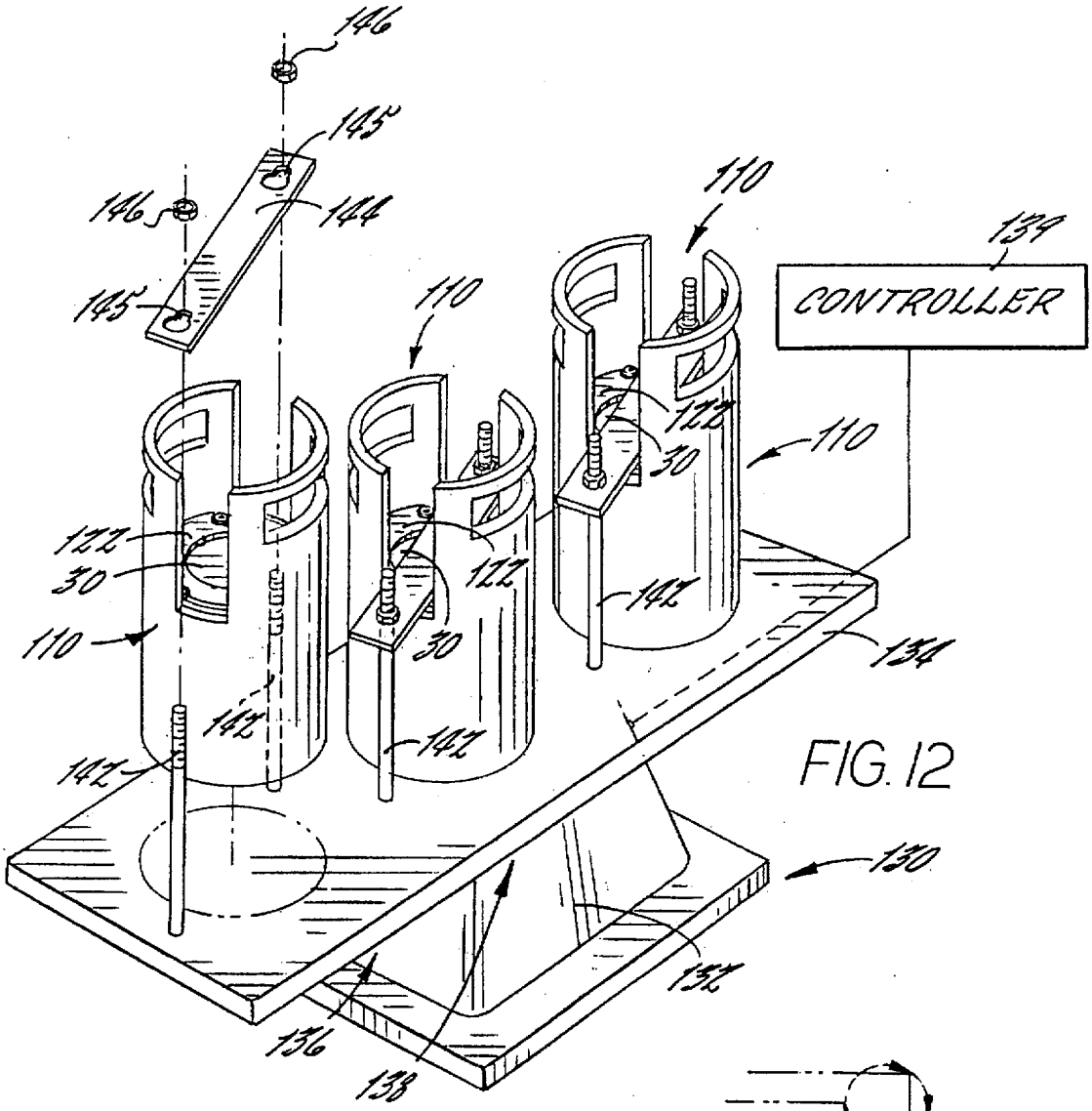
FIG. 12 is a perspective view of a grinding apparatus of the present invention with two assembled mounting receptacles mounted thereon and one mounting receptacle shown in exploded view.

FIG. 12 illustrates the mounting of the mounting receptacle 110 on a grinding apparatus 130. The grinding apparatus 130 includes a frame configured to be fixed to an underlying surface and a platform 134 upon which three exemplary mounting receptacles 110 can be mounted. The grinding apparatus 130 further includes a drive motor 136, which is connected to a drive mechanism 138 for moving the platform 134 along a horizontal circular path (see FIG. 13). The speed of the drive motor 136, and therefore the drive mechanism 138, is controlled by a schematically illustrated controller 139, which is electrically connected to the drive motor 136. Preferably, the controller 139 enables an operator to vary the speed with which the mounting receptacles 110 are moved along the circular path; preferably, for the grinding of a pharmaceutical composition, the controller 139 should be set so that the mounting receptacles 110 are revolved at a speed of between about 300 and 500 revolutions per minute; and more preferably at a speed of between about 350 and 450 revolutions per minute. The diameter of the circular path should be selected so that the grinding disk 45 follows as a rolling action within the grinding cavity 44; for example,.a grinding vessel 30 having a grinding cavity 44 with a diameter of about 5 inches and a grinding disk 45 with a diameter of about 3 inches preferably follows a circular path with a diameter of 6 inches.

Figure 13:
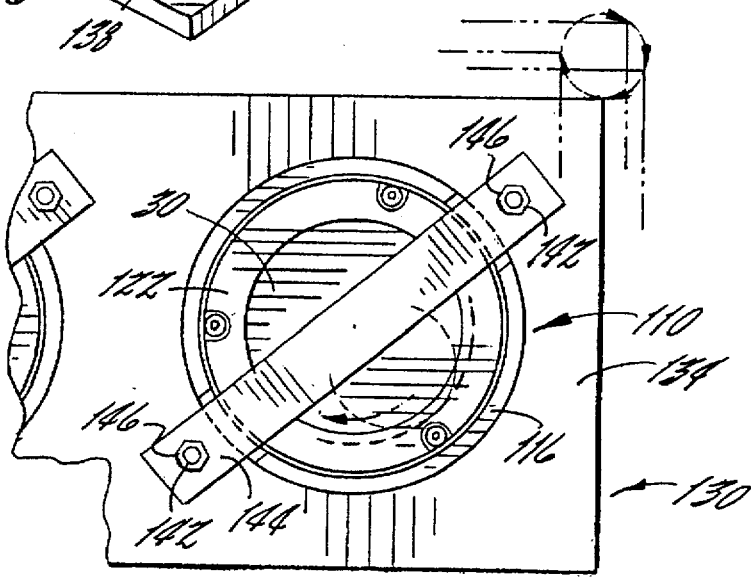
FIG. 13 is an enlarged top view of one of the assembled mounting receptacles of FIG. 12 showing the circular path followed by the grinding apparatus platform during operation.

Each of the mounting receptacles 110 is mounted directly onto the surface of the platform 134. As shown in FIGS. 12 and 13, the mounting receptacle 110 is lowered between a pair of bolts 142, each of which extends upwardly past the lower portion of the loading slots 118 of the mounting receptacle 110. A retaining bar 144 having an aperture 145 at either end is then lowered into the locking slots 118 so that the upper ends of the bolts 142 are received within the apertures 145. The retaining bar 144 is fixed into place via two nuts 146, each of which fits upon a respective bolt 142 and is tightened thereon.

Figure 14:
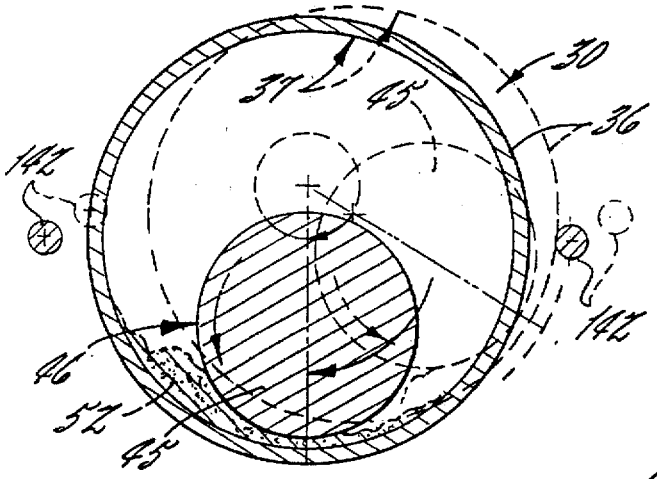
FIG. 14 is a top sectional view of a grinding vessel illustrating the relative position of the mounting frame of the grinding apparatus, the grinding vessel and the grinding disk contained therein.
Figure 15:
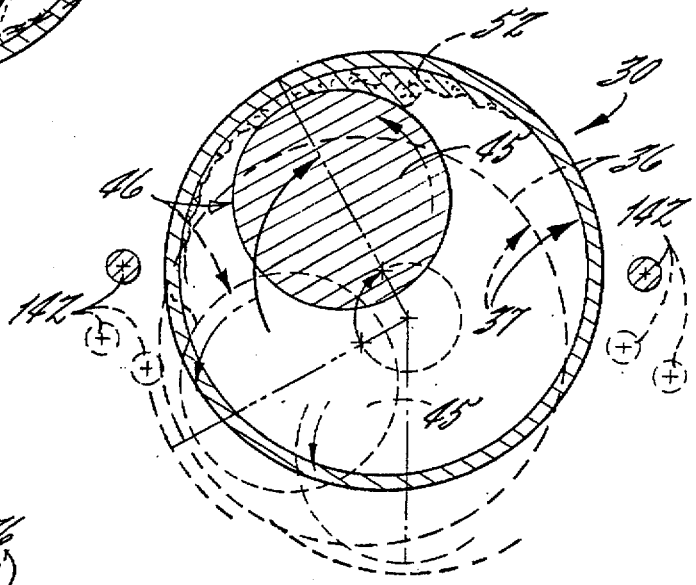
FIG. 15 is a top sectional view of the grinding apparatus and vessel of FIG. 14 illustrating the relative movement of the grinding disk within the grinding vessel.
Figure 16:
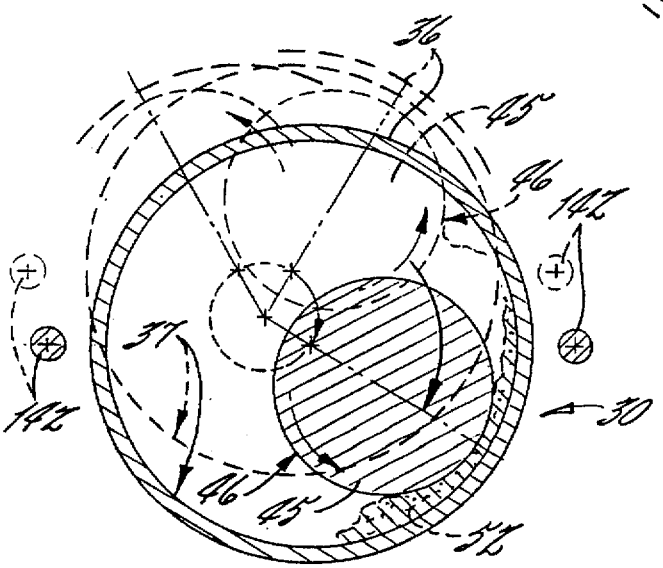
FIG. 16 is a top sectional view of the grinding apparatus and disk of FIG. 15 showing further rotational movement of the grinding disk within the grinding vessel.

The grinding operation itself is illustrated in FIGS. 14 through 16. Grinding is initiated by energizing the controller 139, which in turn causes the drive motor 136 to drive the drive mechanism 138, and thus the platform 140, in a circular motion. The mounting receptacles 110 remain fixed relative to the platform 140. As shown in FIGS. 14 through 16, the grinding disk 45 moves within the grinding cavity 44 such that its cylindrical surface 46 contacts and rolls the tablets against the internal surface 37 of the grinding cavity 44. This rolling action between the disk 45 and the grinding cavity 44 (as opposed to pulverizing or crushing action such as that of prior art pharmaceutical apparatus used to produce powders) causes the disk 45 to grind the tablets 52 into a powder formed of particles having a generally uniform size. As used herein, particles of "generally uniform size" to have a size distribution such that at least 50 percent of the particles are within a group in which size varies by no more than 10 percent, or such that at least 80 percent of the particles are within a group in which size varies no more than 20 percent.

The relatively low rotational speed (300 to 500 rpm) at which the grinding occurs generates little heat within the grinding cavity 44. Typically the elevation in temperature of the compound, which is dependent on the amount of material, the speed and the time of the grind, is less than about 30° C., and in most grinding sessions is less than about 20° C. This low heat generation significantly reduces the risk of degrading or decomposing any active agent contained within the solid, even an organic compound, and also diminishes the risk that the agent may undergo a solid state polymorphic phase transition. Also, because each grinding vessel 30 mounted within one of the three mounting receptacles 110 is subjected to the same rotational speed and duration, and because substantially equivalent amounts of the solid tablets 52 can be introduced into each grinding vessel 30, reproducibility among samples of the same solid material ground in different grinding vessels 30 can be quite high. Moreover, because the variables that can effect grinding, such as grinding speed, grinding time, and amount of solid to be ground can be easily controlled, samples ground at different times tend to be very consistent and reproducible.

Figure 17:
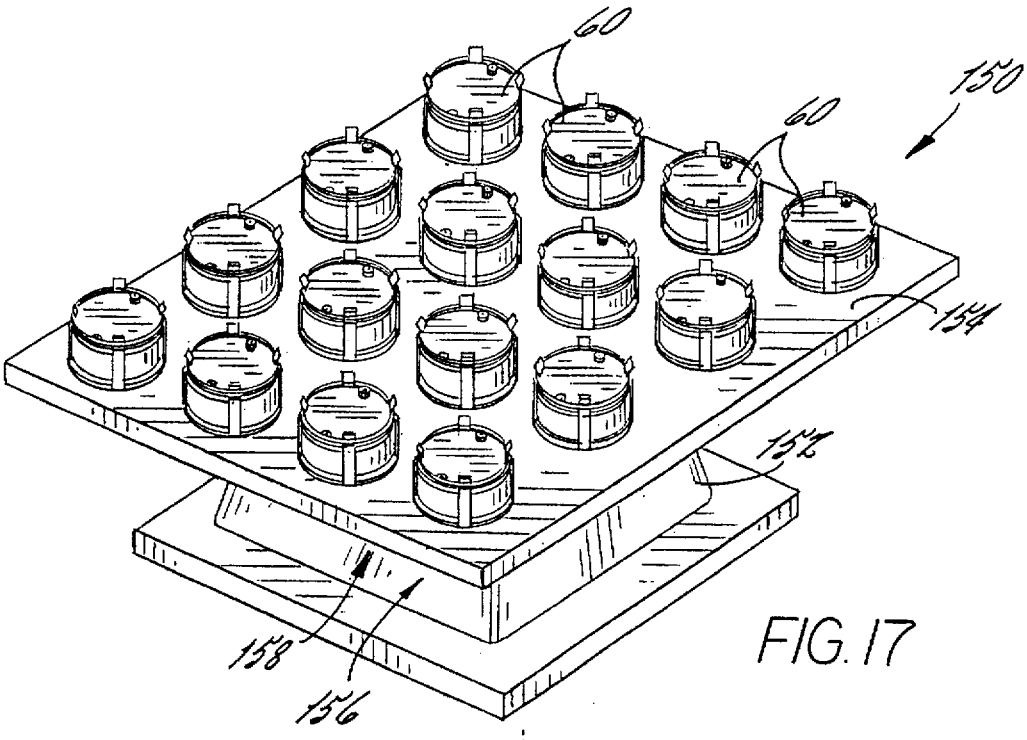
FIG. 17 is a perspective view of an alternative grinding apparatus embodiment particularly suitable for use with the grinding vessel illustrated in FIGS. 5 through 8 with a plurality of such vessels mounted thereon.
Figure 18:
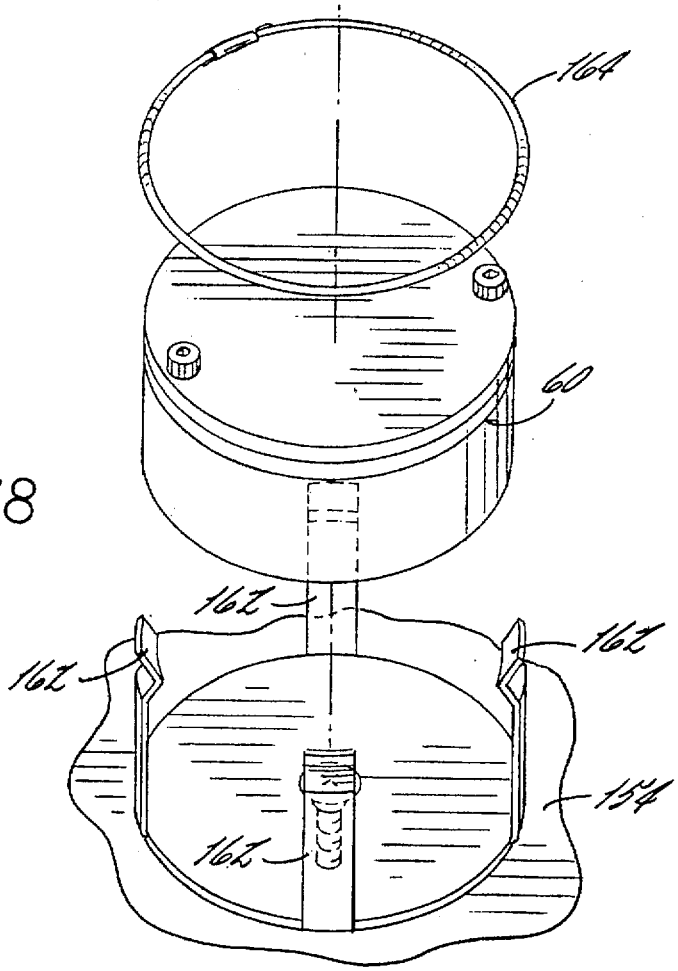
FIG. 18 is an enlarged exploded view of mounting clips and an elastic band used to mount a grinding vessel of FIG. 17.

An alternative grinding apparatus, designated broadly at 150, is illustrated in FIGS. 17 and 18. The grinding apparatus 150 is particularly suitable for use with the grinding vessel 60 illustrated in FIGS. 5 through 8. The grinding apparatus 150 includes a base 152, a platform 154, a drive motor 156, a drive mechanism 158, and a controller (not shown) that are connected much like their corresponding parts in the grinding apparatus 130 illustrated hereinabove. However, the grinding vessels 60 are mounted to the platform 160 via a quartet of metallic clips 162. Once the grinding vessel 160 has been inserted within the clips 162, it is further retained via an elastic band 164 (FIG. 18) that biases the top portions of the clips 162 inwardly.

Grinding with the grinding apparatus 150 proceeds in a similar manner to that described above for the grinding apparatus 130; the platform 154, and in turn the grinding vessels 60, are driven by the drive mechanism 158 along a circular path. This action causes the grinding disk 75 to contact and roll on the internal surface 67 of the grinding cavity 74. Particularly when the rotational speed of the platform is between about 300 to 500 rpm, grinding a solid material within the grinding vessel 60 produces a powder comprising granules of generally uniform size, and does so while generating relatively little heat. 5 As such, solid pharmaceutical materials, even those having an organic active agent, can be ground into granules that accurately reflect the composition of the solid and that can be consistently reproduced in different samples.

Either of the grinding apparatus illustrated in FIGS. 12 through 18 can also be employed to mix solid powders of two or more different materials, particularly pharmaceutical materials. In such a process, the powders to be mixed are loaded into a grinding vessel, such as the grinding vessel 30, along with a grinding disk 45. The grinding vessel 30 is then loaded into a mounting receptacle 110, which is subsequently mounted onto the grinding apparatus 130. The grinding apparatus is operated via the controller 139 as described hereinabove; preferably, the rate of grinding is between about 300 and 500 rpm. The resulting powder is an essentially homogeneous mixture of the original powders, and the absence of substantial heat generation prevents degradation or solid state polymorphic phase transition of the active agents of the pharmaceuticals.

The foregoing embodiments are illustrative of the present invention, and are not to be construed as limiting thereof. The invention is defined by the following claims, with equivalents of the claims to be included therein.

That which is claimed is:

1. An apparatus for grinding a solid material, comprising:

a mounting frame;

a first grinding vessel mounted on said mounting frame, said first grinding vessel having a substantially planar floor, a substantially planar ceiling, said ceiling and said floor having substantially parallel facing surfaces, and a substantially circular internal wall, said floor, ceiling and internal wall defining a first vessel cavity;

a first circular grinding disk positioned within the first grinding vessel cavity; and revolving means attached to said mounting frame for revolving said first grinding vessel along an essentially circular path such that said first grinding disk contacts and rolls against said first vessel cavity internal wall and thereby grinds solid material contained within the first vessel cavity into granules of substantially uniform size;

wherein said revolving means including means for adjusting the rate at which said first grinding vessel revolves along the circular path, and wherein said revolving means is configured to revolve at a rate such that the temperature of the solid material rises no more than 30° C. during grinding.

2. The apparatus defined in claim 1, wherein said revolving means includes means for adjusting the rate along which said first grinding vessel revolves along the circular path.

3. The apparatus defined in claim 1, wherein said revolving means is configured to revolve said first grinding vessel along the essentially circular path at a rate of between about 300 and 500 revolutions per minute.

4. The apparatus defined in claim 1, wherein each of said first grinding disk and said first vessel cavity has a diameter dimension, and wherein said first grinding disk diameter dimension is at least one-half of said first vessel cavity diameter dimension.

5. The apparatus defined in claim 1, wherein each of said first grinding disk and said first vessel cavity has a height dimension between said ceiling and floor facing surfaces, and wherein said first grinding disk height dimension is slightly less than said first vessel cavity height dimension.

6. The apparatus defined in claim 1, further comprising a second grinding vessel mounted to said mounting frame, said second grinding vessel having a substantially planar floor, a substantially planar ceiling, said ceiling and said floor having substantially parallel facing surfaces, and a substantially circular internal wall, said floor, ceiling and internal wall defining a second vessel cavity;

a second circular grinding disk positioned within the second grinding vessel cavity; and wherein said revolving means is configured to revolve said second grinding vessel along an essentially circular path such that said second grinding disk contacts and rolls against said second vessel cavity internal wall and thereby grinds solid material contained within the second vessel cavity into granules of substantially uniform size.

7. The apparatus defined in claim 6, wherein said second grinding vessel is mounted to said mounting frame adjacent to said first grinding vessel.

8. The apparatus defined in claim 6, wherein said second grinding vessel is mounted above said first grinding vessel in stacked relationship, with said first and second vessel cavity ceiling surfaces being substantially parallel and said first and second vessel cavity internal walls being substantially aligned.

9. A method of grinding a solid pharmaceutical composition into granules of substantially uniform size, comprising the steps of:

loading a grinding vessel with a solid pharmaceutical composition, said grinding vessel having an internal grinding cavity defined by a ceiling, a floor opposed and parallel to the vessel ceiling, and a circular internal wall;

inserting a substantially circular grinding disk into the grinding cavity; and revolving the grinding vessel along a substantially circular path at a rate and for a time sufficient to grind the solid pharmaceutical composition into granules of a substantially uniform size and such that the temperature of the solid material rises no more than about 30° C. during grinding.

10. The method defined in claim 9, wherein the solid pharmaceutical composition is a heat-sensitive composition.

11. The method defined in claim 9, wherein said revolving step comprises revolving said first grinding vessel along the essentially circular path at a rate of between about 300 and 500 revolutions per minute.

12. The method defined in claim 9, further comprising the steps of:

loading a second grinding vessel with the pharmaceutical composition, said second grinding vessel having an internal grinding cavity defined by a ceiling, a floor opposed and parallel to the vessel ceiling, end a circular internal wall;

inserting a second circular grinding disk into the second grinding cavity; and revolving the second grinding vessel simultaneously with the step of revolving the first grinding vessel.

* * * * *